US005098517A

United States Patent [19]

Tytgat et al.

[11] Patent Number: 5,098,517

[45] Date of Patent: Mar. 24, 1992

[54] BATHS AND PROCESS FOR CHEMICAL POLISHING OF COPPER OR COPPER ALLOY SURFACES

[75] Inventors: Daniel Tytgat, Brussels; Stefaan Magnus, Halle, both of Belgium

[73] Assignee: Solvay & Cie (Société Anonyme), Brussels, Belgium

[21] Appl. No.: 602,617

[22] Filed: Oct. 24, 1990

[30] Foreign Application Priority Data

Oct. 24, 1989 [BE] Belgium ..... 08901150

[51] Int. Cl.[5] ..... B44C 1/22; C23F 1/00

[52] U.S. Cl. ..... 156/666; 156/651; 156/903; 252/79.2; 252/79.4

[58] Field of Search ..... 252/79.2, 79.4; 156/651, 656, 666, 903

[56] References Cited

U.S. PATENT DOCUMENTS 3,345,225 10/1967 Lacal ..... 156/903 X

FOREIGN PATENT DOCUMENTS 0309031 3/1989 European Pat. Off. .
284558 2/1914 Fed. Rep. of Germany .
2392100 12/1978 France .
1211338 2/1986 U.S.S.R. .
1449525 9/1976 United Kingdom .

OTHER PUBLICATIONS

Japanese Patent Gazette; Derwent Publ. Ltd. Section Chemical Semaine X09; Res. No. 15396X/09; 4-7-76.
Electroplating, 10/1953; pp. 360-367, "Theory and Practice of Chemical Polishing".
Tegart et al., "Electrolytic and Chemical Polishing of Metals", Chapters 10 and 11, pp. 122-137 (1960), and English translation thereof.

*Primary Examiner*—William A. Powell
*Attorney, Agent, or Firm*—Spencer, Frank & Schneider

[57] ABSTRACT

Baths for chemical polishing of copper or copper alloy surfaces, comprising, in aqueous solution, hydrogen peroxide, phosphoric acid and tetraborate ions.

8 Claims, No Drawings

BATHS AND PROCESS FOR CHEMICAL POLISHING OF COPPER OR COPPER ALLOY SURFACES

The present invention relates to the composition of baths for chemical polishing of copper or copper alloy surfaces.

Chemical polishing of metal surfaces is a well-known technique (Polissage électrolytique et chimique des métaux [Electrolytic and Chemical Polishing of Metals]—W. J. Mc G. TEGART—Dunod—1960—p.122 et seq.); it consists in treating the metal surfaces to be polished with oxidizing baths.

Aqueous baths of orthophosphoric acid, nitric acid and acetic acid have been used for chemical polishing of copper and its alloys (ditto: pages 135 and 136). These baths require high operating temperatures of the order of 50° to 80° C. and vigorous mechanical stirring. Moreover, they attack the metal at high speed, restricting the polishing time to less than 5 minutes. These characteristics of these known baths are disadvantages: on the one hand, their use is accompanied by emissions of toxic gases and, on the other hand, their high speed of action and the need to subject them to mechanical stirring makes the control of polishing difficult and problematical. To overcome these disadvantages, aqueous baths comprising hydrogen peroxide and a mixture of nitric, phosphoric and hydrochloric acids have been proposed. These aqueous baths allow lower operating temperatures, of the order of 25° to 35° C., and their speed of attack on the metal is between 2.5 and 5 microns per minute [Electroplating—October 1953—6—pages 360 to 367 (pages 363 and 364)]. The speed of action of these known baths on the metal is, however, still excessive for some applications. It renders them, in particular, unusable for polishing the internal face of the walls of tanks of large size, such as boilers, autoclaves or crystallizers. The time required for filling and emptying such tanks being generally considerably longer than the optimum chemical polishing treatment time, it in fact becomes impossible to obtain a uniform polish of the wall, some zones of the latter being insufficiently polished and others being deeply corroded. These known baths are also ineffectual for polishing surfaces at the contact with which replenishment of the bath is difficult, since severe changes in the local compositions of the bath result.

Baths comprising, in aqueous solution, phosphoric acid, hydrogen peroxide, hydrochloric acid and 2,6-dit-ert-butyl-4-N,N-dimethylaminomethylphenol have also been proposed [SU-A-1211338 (ORG. PHYS. CHEM. INST.)]. These known baths would have the characteristic of a better stability, but they imply operating temperatures of at least 50° C., their speed of action is too rapid and they do not permit polishings of regular quality.

In the document EP-A-309031 (SOLVAY & CIE) chemical polishing baths which overcome the abovementioned disadvantages are proposed, these baths comprising, in aqueous solution, hydrogen peroxide, chloride ions and a mixture of phosphoric acid, phosphate ions and hydrogen phosphate ions.

The invention aims to provide another composition for polishing baths which likewise overcome the disadvantages enumerated above and which effect polishes of good quality with a slow speed of action and a moderate loss of metal.

Accordingly, the invention relates to baths for chemical polishing of copper or copper alloy surfaces, comprising, in aqueous solution, hydrogen peroxide, phosphoric acid and tetraborate ions.

In the baths according to the invention, the hydrogen peroxide serves as oxidizing agent for the metal to be polished.

The phosphoric acid and the tetraborate ions serve as buffer mixture for the aqueous solution, the pH of which must be acid. The tetraborate ions can be used in the form of any water-soluble inorganic compounds, such as tetraboric acid or the alkali metal salts, for example anhydrous or hydrated borax.

As a general rule, it is recommended that the phosphoric acid and the tetraborate ions are present in the aqueous solution in respective amounts controlled to confer on said solution a pH value not higher than 3 and preferably between 1 and 2.8, the optimum values being between 1.4 and 2.5. These pH values are those effectively measured in the aqueous solution of the baths according to the invention (apparent pH); they generally differ from the theoretical values obtained by mathematical calculation from the phosphoric acid and tetraborate ion contents in the aqueous solution.

By means of the achievement of the abovementioned pH value in the aqueous solution of the polishing bath, the respective contents of hydrogen peroxide, phosphoric acid and tetraborate ions are chosen as a function of the nature of the metal treated, the operating temperature and the desired time for the polishing treatment. Baths according to the invention which are suitable for the majority of applications are those comprising, per liter of the aqueous solution, from 1 to 5 moles of hydrogen peroxide, from 0.01 to 1 mole of phosphoric acid and from 0.01 to 0.5 mole of tetraborate ions. These polishing baths according to the invention are suitable for polishing at slow speed, requiring a contact time of more than one hour between the surface and the bath, the temperature of which can, moreover, be moderate, generally lower than 70° C., for example between 20° and 50° C.

The aqueous solution of the baths according to the invention can optionally contain, in the customary proportions, additives commonly present in the aqueous baths for chemical polishing of metals, for example surfactants, viscosity regulators and stabilizers for the hydrogen peroxide.

The chemical polishing baths according to the invention enable surface polishes to be obtained which are of good quality, in particular superior to that of the polishes obtained with the polishing baths described in the document SU-A-1211338. A great advantage of the baths according to the invention lies in their ability to produce polishings at moderate speed of action, which can be spread over several hours, so as to permit the uniform polishing of surfaces which are of large size or not readily accessible. The baths according to the invention have the advantageous characteristic of restricting the loss of metal from the metal surfaces subjected to polishing to a moderate value, while achieving a polish of a quality at least equal and generally superior to the quality of the polish obtained with the known polishing baths. This characteristic of the baths according to the invention makes them very particularly intended for the treatment of thin metal parts; moreover, it reduces the loss in mechanical strength of the metal parts subjected to polishing.

The baths according to the invention are suitable for polishing all copper or copper alloy, for example brass, surfaces.

The invention accordingly also relates to a process for polishing the surface of an object made of copper or copper alloy, according to which process the surface to be polished is brought into contact with a polishing bath according to the invention.

In the process according to the invention, the polishing bath can be used at all temperatures and pressures at which there is no risk of its constituents being degraded. It has, however, proved advantageous to use the bath at atmospheric pressure, at a temperature higher than 20° C. and lower than 80° C., the temperatures between 30° and 60° C. being preferred.

The metal surface can be brought into contact with the bath in any suitable manner, for example by immersion.

In the process according to the invention, the contact time of the surface to be polished with the bath must be sufficient to achieve an effective polishing of the surface; however, it may not exceed a critical value beyond which there is a risk of local corrosion appearing on the surface. The optimum contact time depends on numerous parameters, such as the constituent metal or alloy of the surface to be polished, the shape and the initial roughness of said surface, the composition of the bath, the operating temperature, any turbulence of the bath in contact with the surface and the ratio between the area of the metal surface to be polished and the volume of the bath used; it must be determined by a routine laboratory operation in each particular case.

In a preferred embodiment of the process according to the invention, the surface to be polished is kept in contact with the bath for a time sufficient to achieve an attack on the metal to a depth of at least 5 microns, preferably less than 50 microns, for example between 10 and 30 microns. The time for which the surface is treated with the bath is thus, in the majority of cases, between 1 and 6 hours.

In another particular embodiment of the process according to the invention, the metal surface to be polished is brought into contact successively with a first polishing bath according to the invention and with a second chemical polishing bath comprising, in aqueous solution, hydrogen peroxide, chloride ions and a mixture of phosphate ions and hydrogen phosphate ions in respective amounts controlled so as to confer on the aqueous solution a pH value of between 1.25 and 3. Details regarding the composition of the second polishing bath used in this embodiment of the process according to the invention can be obtained from the document EP-A-309031 (SOLVAY & CIE). This particular embodiment of the process according to the invention permits a polish of optimum quality in conjunction with a minimum loss of metal.

The value of the invention will be demonstrated on reading the application examples given below.

EXAMPLE 1 (ACCORDING TO THE INVENTION)

A copper plate 10 $cm^2$ in area was immersed in 500 $cm^3$ of a bath kept under agitation and containing, per liter:

3.5 moles of hydrogen peroxide,
0.48 mole of phosphoric acid, and
0.2 mole of borax ($Na_2B_4O_7 \bullet 10H_2O$).

The pH value of the bath thus prepared was measured: 2.2.

The temperature of the bath was kept at about 40° C. throughout the immersion period, which was 6 hours. At the end of this period, the plate was withdrawn from the bath, rinsed with demineralized water and dried. The following were measured:

before and after immersion, the arithmetic average roughness $R_a$, which is the mean deviation relative to the average surface of the plate [Encyclopedia of Materials Science and Engineering, Michael B. Bever, Vol. 6, 1986, Pergamon Press, pages 4806 to 4808 (page 4806)]:

$$R_a = \frac{1}{L}\int_0^L |y(x)|\,dx$$

the depth of attack on the metal, defined by the relationship $$\Delta e = \frac{10^4}{S \cdot d} \cdot \Delta P$$

where

S denotes the area of the plate (in $cm^2$),
d denotes the specific mass of the metal (in $g/cm^3$),
$\Delta P$ denotes the loss in weight (in g) of the plate during immersion in the bath, and
$\Delta e$ denotes the depth of attack (in $\mu m$).

The following results were obtained:

$R_a$ (before immersion) = 0.52 $\mu m$,
$R_a$ (after immersion) = 0.07 $\mu m$,
$\Delta e$ = 18 $\mu m$.

EXAMPLE 2 (REFERENCE)

The experiment of Example 1 was repeated under operating conditions in accordance with those described in Example 7 of the document SU-A-1211388:

Composition of the polishing bath:
9.4 moles of hydrogen peroxide per liter,
0.584 mole of phosphoric acid per liter,
0.047 mole of hydrochloric acid per liter, and
0.04 g of 2,6-di-tert-butyl-4-N,N-dimethylaminomethylphenol per liter,
pH = 1.05;
Operating temperature: 50° C.;
Treatment time: 15 minutes.

The following results were obtained:

$R_a$ (before immersion) = 0.40 $\mu m$,
$R_a$ (after immersion) =0.08 $\mu m$,
$\Delta e$ = 60 $\mu m$.

A comparison of the two experiments shows that the bath according to the invention has produced a polish of superior quality while giving rise to a smaller loss of metal (depth of attack). It also shows that the use of the polishing bath according to the invention has considerably extended the polishing time, this being another object of the invention.

We claim:

1. Baths for chemical polishing of copper or copper alloy surfaces, comprising, in aqueous solution, hydrogen peroxide, phosphoric acid and tetraborate ions.

2. Baths according to claim 1, characterized in that the tetraborate ions are used in the aqueous solution in the form of alkali metal tetraborate.

3. Baths according to claim 1, characterized in that they contain the phosphoric acid and the tetraborate ions in amounts controlled so as to measure a pH value of less than 3 in the bath.

4. Baths according to claim 3, characterized in that they contain the phosphoric acid and the tetraborate ions in amounts controlled so as to measure a pH value of between 1 and 2.8 in the bath.

5. Baths according to claim 1, characterized in that they comprise hydrogen peroxide in an amount of between 1 and 5 moles per liter, phosphoric acid in an amount of between 0.01 and 1 mole per liter, and tetraborate ions in an amount of between 0.01 and 0.5 mole per liter.

6. Process for polishing a copper or copper alloy surface, according to which process the surface is brought into contact with a chemical polishing bath according to claim 1.

7. Process according to claim 6, characterized in that the surface is kept in contact with the bath for a time sufficient to achieve an attack on the metal to a depth of between 5 and 30 microns.

8. Process according to claim 6, characterized in that after the surface has been brought into contact with the first mention chemical polishing bath, the surface is hereafter brought into contact with a second chemical polishing bath comprising, in aqueous solution, hydrogen peroxide, chloride ions and a mixture of phosphoric acid, phosphate ions and hydrogen phosphate ions.

* * * * *